US007147406B2

(12) United States Patent
Clack

(10) Patent No.: US 7,147,406 B2
(45) Date of Patent: Dec. 12, 2006

(54) WALL STRUCTURE FOR RETAINING SOILS

(76) Inventor: Thomas G. Clack, 2488 Old Fork Rd., Gainesville, GA (US) 30506

( * ) Notice: Subject to any disclaimer, the term of this patent is extended or adjusted under 35 U.S.C. 154(b) by 0 days.

(21) Appl. No.: 10/856,309

(22) Filed: May 28, 2004

(65) Prior Publication Data

US 2005/0265791 A1 Dec. 1, 2005

(51) Int. Cl.
*E02D 29/02* (2006.01)

(52) U.S. Cl. ..... 405/284; 405/262

(58) Field of Classification Search ..... 405/284, 405/286, 272, 262; 52/604
See application file for complete search history.

(56) References Cited

U.S. PATENT DOCUMENTS

| | | | | |
|---|---|---|---|---|
| 2,076,267 | A * | 4/1937 | Edwards | 52/250 |
| 2,222,908 | A * | 11/1940 | King | 52/59 |
| 2,929,238 | A | 3/1960 | Kaye | 72/103 |
| 3,378,949 | A * | 4/1968 | Dorris | 47/33 |
| 4,824,293 | A | 4/1989 | Brown et al. | 405/284 |
| 5,560,172 | A * | 10/1996 | Brophy et al. | 52/596 |
| 5,788,423 | A * | 8/1998 | Perkins | 405/284 |
| 6,056,479 | A | 5/2000 | Stevenson et al. | 405/258 |
| 6,193,445 | B1 | 2/2001 | Scales | 405/284 |
| 6,505,999 | B1 * | 1/2003 | Lothspeich | 405/284 |
| 6,663,323 | B1 * | 12/2003 | Boys | 405/284 |
| 2003/0002924 | A1 | 1/2003 | Lothspeich | 405/284 |
| 2003/0140588 | A1 * | 7/2003 | Sucato, Jr. | 52/506.01 |

FOREIGN PATENT DOCUMENTS

| | | | |
|---|---|---|---|
| JP | 10212717 A | * | 8/1998 |
| JP | 2003221833 A | * | 8/2003 |

* cited by examiner

*Primary Examiner*—Naoko N. Slack
*Assistant Examiner*—Gay Ann Spahn
(74) *Attorney, Agent, or Firm*—Thoma, Kayden, Horstemeyer & Risley, LLP

(57) ABSTRACT

A retaining wall structure for retaining soil, including a retaining wall including a plurality of non-molded blocks disposed side-by-side and adjacent each other, the retaining wall having a width and a height. The wall structure further includes a plurality of joints being defined by adjacent of the non-molded blocks, a cementitious compound disposed in the plurality of joints, the cementitious compound securing adjacent ones of the non-molded blocks to each other, and an anchor sheet including a proximal end and a distal end. The proximal end of the anchor sheet is embedded in the cementitious compound, the anchor sheet extending outwardly from the retaining wall, and backfill is disposed about the anchor sheet such that the backfill retains the wall structure in a desired position.

13 Claims, 3 Drawing Sheets

WALL STRUCTURE FOR RETAINING SOILS

TECHNICAL FIELD

The present disclosure relates generally to wall structures for retaining soils. More specifically, the present disclosure relates to wall structures constructed of non-molded blocks, and including anchor sheets to maintain the wall structure in a desired position.

BACKGROUND OF THE INVENTION

Steep slopes, embankments, and sub-grades of earth often require stabilization to prevent soil movement. Often, stabilization can be accomplished by using high quality, select soils in the slopes or embankmnents. However, it is often desirable to reuse the soils originally found at the construction site. In such cases, it is often necessary to construct additional structures for effective stabilization of the soil.

Although some soil stabilization applications are effectively achieved by using underlayments and layers of sheet materials, or anchor sheets, which are covered with backfill materials, other applications require the construction of retaining walls. Moreover, some applications require the construction of retaining walls that incorporate anchor sheets for maintaining the retaining wall and soil in their desired positions. Existing retaining walls are typically constructed of a plurality of uniformly shaped, molded blocks which may either be connected together or simply stacked atop each other. For example, some known blocks have bores which receive pins or dowels to connect the molded blocks in vertically adjacent tiers. Still other types of existing molded blocks have opposing top and bottom surfaces which are often configured for interlocking engagement.

As noted, existing retaining walls may also include one or more laterally extending anchor sheets that maintain both the retaining wall and the retained soils in the desired positions. Typically, a portion of each anchor sheet is attached to the retaining wall by the use of connectors, such as clips, pins, etc. disposed in matching holes, etc., or the retained portion may be merely secured between adjacent tiers of molded blocks by the weight of the blocks.

Retaining walls may also be constructed of blocks of naturally occurring stone materials, such as granite, flagstone, fieldstone, etc. Because the blocks of naturally occurring stone material are quarried from the earth rather than being formed in a mold, they typically vary in shape from one block to the next. There are a number of drawbacks of existing retaining walls constructed of natural stone materials. For example, because the blocks are non-molded and non-uniform, they are not as readily stackable as their modular counterparts. As a result, whereas the retaining wall constructed of molded blocks may have a fairly uniform width from the base to the top of the wall, a retaining wall constructed of non-molded, natural stone material typically requires a width at the base of the wall which can be up to as much as one-half the overall height of the wall. As such, typical retaining walls constructed of non-molded blocks require large amounts of materials, and they are rather expensive to construct.

Therefore, there is a need for improved retaining wall structures constructed of naturally occurring, non-molded blocks which address these and other shortcomings of the prior art.

SUMMARY OF THE INVENTION

The retaining wall structure for retaining soil, may include a plurality of courses of non-molded blocks, the plurality of courses being stacked atop one another to form a retaining wall. The wall structure further includes at least one joint being disposed between adjacent ones of said courses, and at least one anchor sheet, the anchor sheet includes a proximal end and a distal end, the proximal end being disposed in said joint and securely held therein, and the distal end extending outwardly from said retaining wall. Backfill is disposed about the anchor sheet such that the backfill retains the wall structure in a desired position.

Another form of the invention includes a retaining wall structure for retaining soil, including a retaining wall including a plurality of non-molded blocks disposed side-by-side and adjacent each other. The wall structure further includes a plurality of joints being defined by adjacent ones of the non-molded blocks, a cementitious compound is disposed in the plurality of joints, and the cementitious compound secures adjacent ones of said non-molded blocks to each other. An anchor sheet that includes a proximal end and a distal end has its proximal end embedded in the cementitious compound, with the anchor sheet extending outwardly from said retaining wall, and backfill is disposed about the anchor sheet such that the backfill retains the wall structure in a desired position.

Another form of the invention is a method of constructing a retaining wall structure. The retaining wall structure includes a first course and a second course of non-molded blocks and cementitious material disposed therebetween. An anchor sheet is secured to the retaining wall structure and embedded in backfill, including forming the first course of a first plurality of non-molded blocks, the cementitious material being placed between adjacent ones of said first plurality of non-molded blocks, placing a first layer of the cementitious material on a top of the first course, embedding a proximal end of the anchor sheet in the cementitious material, forming the second course of a second plurality of non-molded blocks, the cementitious material being placed between adjacent ones of the second plurality of non-molded blocks, and positioning the backfill adjacent the retaining wall structure such that the anchor sheet is embedded in the backfill.

Other objects, features, and advantages of the present disclosure will become apparent upon reading the following specification, taken in conjunction with the accompanying drawings.

BRIEF DESCRIPTION OF THE SEVERAL VIEWS OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION OF THE PREFERRED EMBODIMENT

Figure 1:
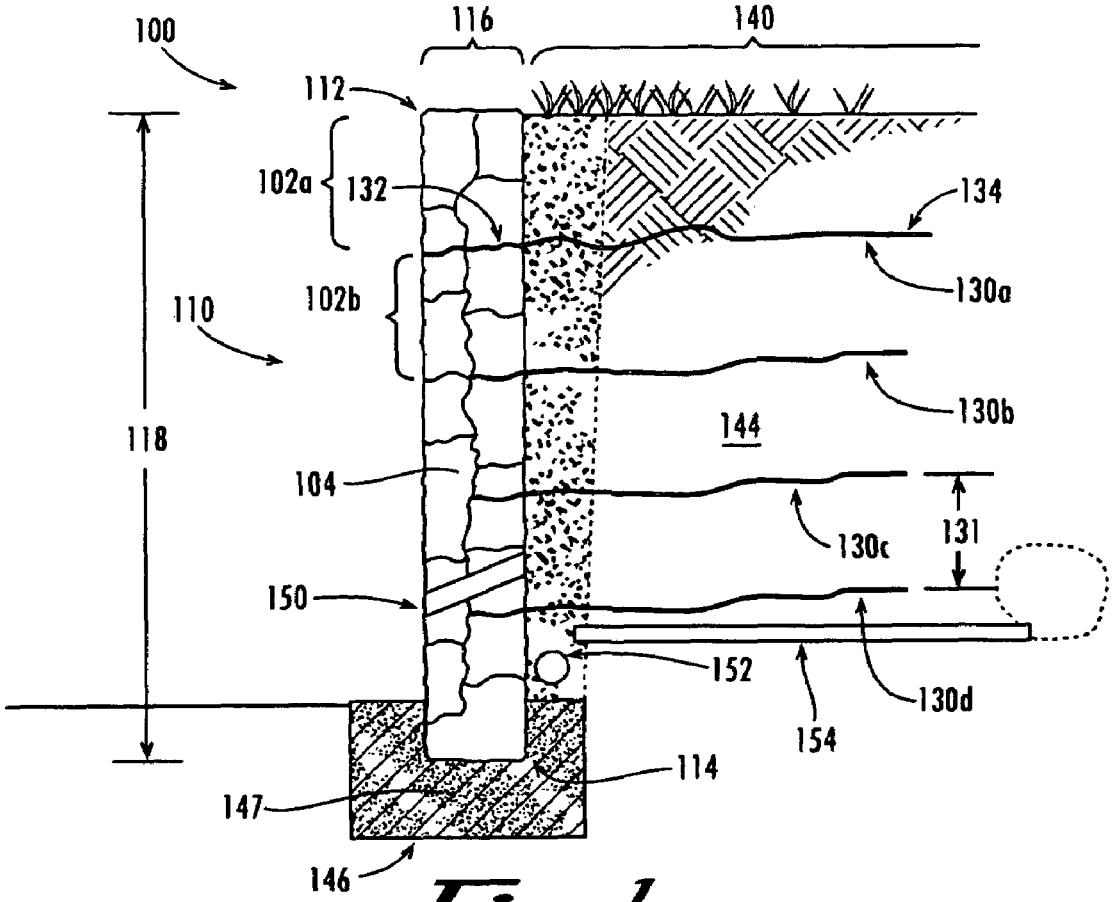
FIG. 1 is a cross-sectional side view of a preferred embodiment of a retaining wall structure constructed in accordance with an embodiment of the present disclosure, used to retain soil.

Reference will now be made in detail to the description of the wall structure for retaining soils as illustrated in the drawings. While the wall structure will be described in connection with the drawings, there is no intent to limit it to the embodiment or embodiments disclosed therein. On the contrary, the intent is to cover all alternatives, modifications and equivalents included within the spirit and scope of the wall structure as defined by the appended claims.

In particular, FIG. 1 illustrates a wall structure 100 for retaining soils, constructed of non-molded blocks 104. As shown, the wall structure 100 includes a retaining wall 110 for maintaining the backfill 140 on the back side 120 of the retaining wall 110 in a desired position. Preferably, the backfill 140 includes a layer of gravel 142 positioned between the retaining wall 110 and the soil 144, which comprises the majority of the backfill 140. One or more anchor sheets 130*a–d* extend from the back side of the retaining wall 110 into the backfill 140. Individual anchor sheets 130*a–d* have been given supplemental letter designations for ease of description only. Preferably, the anchor sheets 130*a–d* are placed at regular intervals along the back side of the retaining wall 110 and extend in a substantially parallel fashion into the backfill 140.

Each anchor sheet 130*a–d* includes a proximal end 132 and a distal end 134, the proximal end 132 being secured to the retaining wall 110 and the distal end 134 extending rearwardly from the retaining wall 110. Generally, the anchor sheets 130*a–d* are substantially flat sheets which define a plurality of large openings or apertures, such as geogrid products produced by Mirafi. However, embodiments of the wall structure 100 are also possible where fine mesh aperture anchor sheets are used as well. During construction of the wall structure 100 backfill 140 covers the anchor sheets 130*a–d*. Rocks, stones and soil in the backfill 140 occupy apertures in the anchor sheets 130*a–d*. These materials mechanically connect the anchor sheets 130*a–d* to the backfill 140, and thereby secure the retaining wall 110 to the backfill 140. As shown, the preferred embodiment also includes a footing 146, a French drain 152, and a weephole 150, as discussed hereafter with regard to construction of the wall structure 100.

The wall structure 100 for retaining soils is constructed as discussed below with reference to FIGS. 1–4. After a site has been selected for the wall structure 100, a footing 146 is constructed for receiving the base 114 of the retaining wall 110. Preferably, the footing 146 is formed of stable, compacted dirt and dimensioned such that crush-in-run 147 (a mixture of sand and gravel) can be positioned behind, below, and in front of the non-molded blocks 104 forming the base 114 of the retaining wall 110. The footing 146 not only provides stability for the retaining wall 110, but also aids in preventing accumulation of standing water about the base 114 of the retaining wall 110. For preferred embodiments of the retaining wall 110 which have a substantially uniform width 116, in the range of 12–30 inches from the base 114 to the top 112, more preferably in the range of 12–18 inches wide from the base 114 to the top 112, an exemplary footing 146 is dimensioned such that approximately 1 foot of crush-in-run 147 is positioned behind, below and in front of the base 114.

After the retaining wall 110 has been constructed of non-molded blocks 104 to a desired height, an anchor sheet 130*a–d* is secured to the retaining wall 110 with a binding compound 122, discussed in greater detail hereafter with regard to FIGS. 2 and 3A–3D. Preferred binding compounds 122 include cementitious compounds such as cement, mortar, etc.

After an anchor sheet 130*a–d* (in the instant case, anchor sheet 130*d*) has been secured to the retaining wall 110, backfill 140 is placed along the back side of the retaining wall up to the height of the anchor sheet 130*d*. Preferably, a layer of gravel 142 is placed adjacent the backside of the retaining wall 110 to aid in the drainage of water therefrom. For example, a one foot layer of gravel 142 performs adequately in this function for preferred embodiments of the retaining wall 110. As shown, the wall structure 100 also includes a French drain 152 in the gravel layer 142 near the base 114 of the retaining wall 110. The French drain 152 consists primarily of a perforated pipe running the substantial length of the retaining wall 110. The French drain 152 aids in preventing the build-up of water at the base 114 of the retaining wall 110. After the layer of gravel 142 and French drain 152 have been positioned adjacent the back side of the retaining wall 110, the remainder of the backfill 140, in this case soil 144, is disposed adjacent the gravel 142 such that the backfill is of a substantially uniform height. The anchor sheet 130*d* is then extended rearwardly and laid along the top surface of the backfill 140 such that the anchor sheet 130*d* is substantially planar.

Preferably, to further assist in preventing the build-up of water behind the retaining wall 110, additional drainage is provided by drain pipe 154 that extends rearwardly into the soil 144 behind the retaining wall 110. One end of the drain pipe 154 is disposed in the layer of gravel 142 that is adjacent the retaining wall 110 and the opposite end is disposed in a mass of gravel (indicated by dashed lines) that is provided in the soil 144. After water drains from the soil 144 into the gravel, the water then flows through the drain pipe 154 to the layer of gravel 142, where it can be further removed by the French drain 152.

Construction of the retaining wall 110 with non-molded blocks 104 secured to each other with binding compound 122 continues until the desired interval 131 between anchor sheets 131 is reached. At this time, another of the anchor sheets 130*c* is secured to the retaining wall 110 of the binding compound 122. As previously discussed, a layer of gravel 142 is positioned against the back side of the retaining wall 110 and then soil 144 is filled in adjacent the layer of gravel 142 until the desired height is reached. The anchor sheet 130*c* is then extended rearwardly in position on top of the recently provided backfill 140. As such, anchor sheet 130*d* is surrounded by backfill 140, thereby helping to maintain the retaining wall 110 in the desired position, as previously noted. Also note, that anchor sheets 130*c*, 130*d* extend rearwardly from the retaining wall 110 such that they are substantially parallel to each other. As shown, a weephole 150 is also built into the retaining wall 110. The weephole 150 is a solid pipe that is positioned so as to aid in draining standing water from behind the retaining wall 110, thereby relieving any excess pressure exerted by the water on the retaining wall 110.

Figure 2:
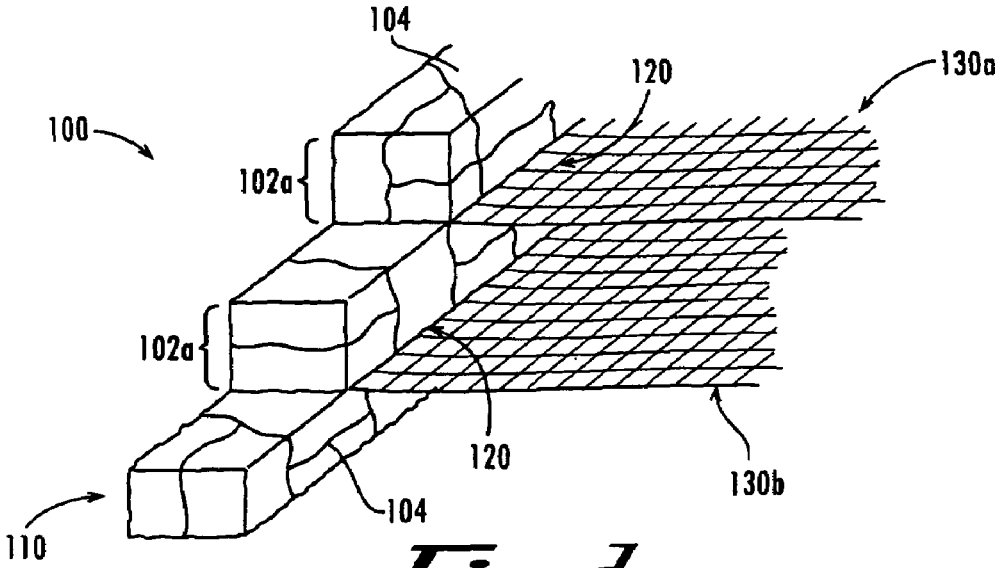
FIG. 2 is a perspective view of a portion of the retaining wall structure shown in FIG. 1 constructed in accordance with an embodiment of the present disclosure.
Figure 3A:
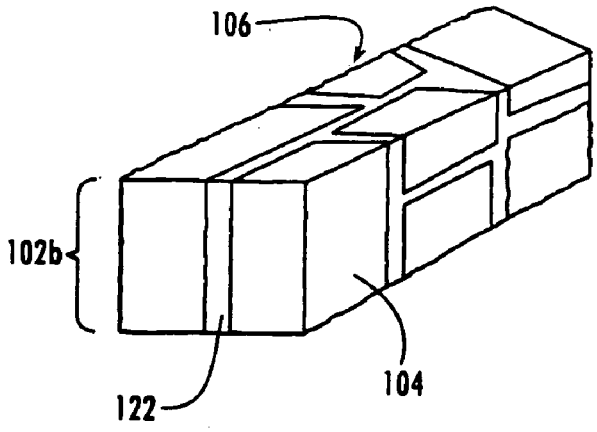
FIGS. 3A–3D illustrate a perspective view of a portion of a preferred embodiment of a retaining wall structure, shown in FIG. 1 constructed in accordance with an embodiment of the present disclosure.
Figure 3B:
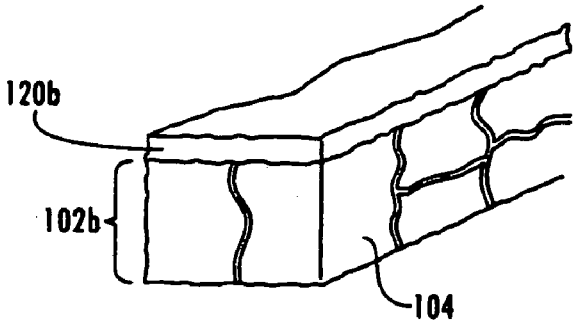
Figure 3C:
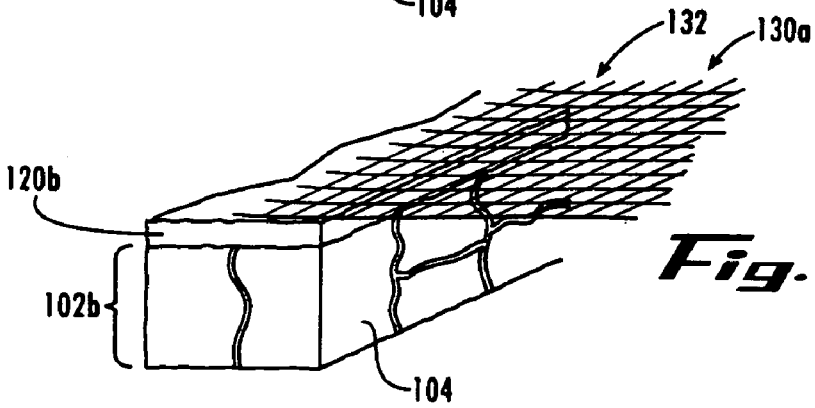
Figure 3D:
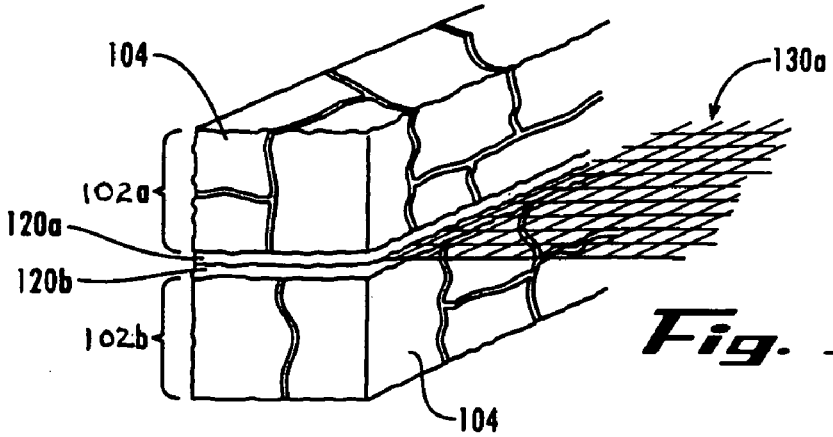

A preferred mode of securing the anchor sheets 130*a–d* to the retaining wall is now discussed. As shown in FIGS. 1 and 2, those portions of the retaining wall 110 referenced by numerals 102*a* and 102*b* are of substantially uniform cross-section although they are constructed on non-uniformly shaped, non-molded blocks 104. For ease of description, these portions of the retaining wall 110 are hereafter referred to as first course 102*a* and second course 102*b*. As shown in FIG. 3A, second course 102*b* is preferably constructed such that it has a substantially flat upper surface 106. Binding compound 122 is used to secure adjacent ones of the non-molded blocks 104 to each other. Once the second course 102*b* has been constructed, a first layer 120*b* of binding compound is disposed along the upper surface 106, as shown in FIG. 3B. The proximal end of the anchor sheet 130*a* is positioned on top of the first layer 120*b* (FIG. 3C). The proximal end 132 may be positioned at varying depths along the width of the retaining wall 110 depending upon the required holding strength between the anchor sheet 130*a* and the retaining wall 110.

After positioning the proximal end 132 on the first layer 120*b* of binding compound, a second layer 120*a* of binding compound is disposed on top of both the first layer 120*b* of binding compound and the proximal end 132 of the anchor sheet 130*a*, thereby embedding the proximal end 132 of the anchor sheet 130*a* in the binding compound. Next, the first course 102*a* is constructed on top of the second layer 120*a* of binding compound, thereby further embedding the proximal end 132 of the anchor sheet 130*a* in the binding compound. Note, embodiments are envisioned wherein the anchor sheets 130*a–d* are secured to the retaining wall 110 with only one layer of binding compound. However, two layers are preferentially used to ensure that the binding compound adequately surrounds the apertures of the anchor sheets 130*a–d*, thereby ensuring the anchor sheets 130*a–d* are adequately secured to the retaining wall 110.

Figure 4:
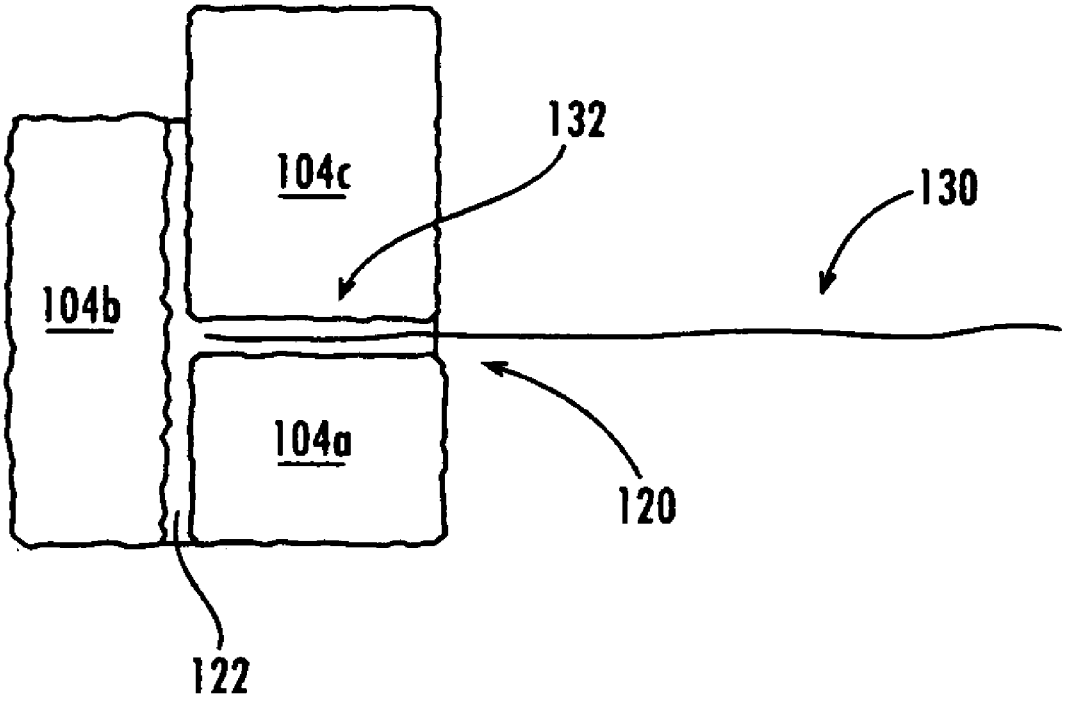
FIG. 4 is a side view of a portion of a retaining wall structure constructed in accordance with an embodiment of the present disclosure.

As shown in FIG. 4, embodiments of the wall structure 100 are envisioned wherein the retaining wall 110 is not constructed of fairly uniform courses such as 102*a*, 102*b*, as previously discussed. For example, random positioning of non-molded blocks, such as 104*a–c*, may result in a non-uniform upper surface on which it is desired to secure an anchor sheet 130. In these instances, it is envisioned that the proximal end 132 of the anchor sheet 130 does not lie in a substantially uniform plane. As well, embodiments are envisioned wherein the depth to which the proximal end may be secured to the retaining wall 110 is limited by positioning of the non-molded blocks, such as 104*b* of FIG. 4.

Although preferred embodiments of the wall structure for retaining soils have been disclosed in detail herein, it will be obvious to those skilled in the art that variations and modifications of the disclosed embodiments can be made without departing from the spirit and scope of the wall structure as set forth in the following claims.

What is claimed is:

1. A retaining wall structure for retaining soil, comprising:

a plurality of courses of non-molded blocks, each course of blocks including a plurality of blocks positioned side-by-side, said plurality of courses of blocks being stacked atop one another to form a retaining wall having a width and a height;

at least one anchor sheet, said anchor sheet including a proximal end and a distal end, said proximal end being disposed between adjacent courses of blocks and spanning a plurality of blocks in the adjacent courses of blocks, said distal end of said anchor sheet extending outwardly from said retaining wall, a binding compound disposed between the blocks in each of the courses of blocks and forming joints in each course of blocks that join the blocks in the same courses of blocks together, and a binding compound disposed between the courses of the blocks and forming joints that join the adjacent courses of blocks together such that the binding compound binds the horizontal and vertical facing surfaces of the blocks together, said proximal end of said anchor sheet is embedded in said binding compound in the joints between the courses of blocks such that said anchor sheet is secured in the joints between the courses of blocks of said retaining wall, said anchor sheet comprises a geogrid web material and said binding compound disposed between the courses of blocks extends about and through the geogrid web material, and backfill disposed about said distal end of said anchor sheet such that said backfill retains the wall structure in a desired position.

2. The retaining wall structure of claim 1, wherein said anchor sheet and said binding compound bind adjacent blocks in adjacent courses of blocks together.

3. The retaining wall structure of claim 2, wherein said binding compound is a cementitious compound.

4. The retaining wall structure of claim 2, wherein each of said non-molded blocks are formed of granite.

5. The retaining wall structure of claim 2, said width being less than approximately 25 percent of said height of said retaining wall.

6. The retaining wall structure of claim 2, wherein said backfill further comprises a layer of gravel adjacent said retaining wall, and soil adjacent said layer of gravel.

7. The retaining wall structure of claim 2, wherein said width is substantially uniform from a base to a top of the retaining wall.

8. A retaining wall structure for retaining soil, comprising:

a retaining wall including a plurality of non-molded blocks disposed side-by-side in courses of blocks, said retaining wall having a width and a height;

a first plurality of joints being defined by adjacent ones of said blocks in the courses of blocks and a second plurality of joints being defined by the adjacent courses of blocks;

a cementitious compound disposed in both said first and second plurality of joints, said cementitious compound securing adjacent ones of said non-molded blocks to each other such that the horizontal and vertical facing surfaces of the blocks are joined together;

at least one anchor sheet formed of geogrid web material defining a plurality of openings, said anchor sheet including a proximal end and a distal end, said proximal end of said anchor sheet positioned in the cementitious compound of the joint between the courses of blocks and spanning a plurality of said blocks and being embedded in said cementitious compound, said distal end of said anchor sheet extending outwardly from said retaining wall; and backfill disposed about the distal end of said anchor sheet for retaining the wall structure in a desired position.

9. The retaining wall structure of claim 8, wherein each of said plurality of non-molded blocks are formed of granite.

10. The retaining wall structure of claim 8, wherein each of said plurality of non-molded blocks further comprises naturally occurring stone.

11. A method of constructing a retaining wall structure, the retaining wall structure including a first course, a second course, a cementitious material disposed therebetween, and an anchor sheet having a proximal end secured to the retaining wall structure and a distal end embedded in backfill, comprising:

forming the first course of a first plurality of non-molded blocks, placing cementitious material between adjacent ones of said first plurality of non-molded blocks in the first course of blocks to bond the blocks in the first course together;

placing a first layer of the cementitious material on an upper surface of the first course of blocks;

embedding a proximal end of the anchor sheet in the first layer of cementitious material with the proximal end of the anchor sheet spanning a plurality of the blocks in the first course of blocks;

forming the second course of a second plurality of non-molded blocks on the first layer of cementitious material and on the proximal end of the anchor sheet, placing cementitious material between adjacent ones of said second plurality of non-molded blocks in the second course of blocks to bond the blocks in the second course together;

placing a second layer of cementitious material between adjacent ones of said second plurality of non-molded blocks; and positioning the backfill adjacent the retaining wall structure and on the distal end of the anchor sheet such that the anchor sheet is embedded in the backfill, such that the horizontal and vertical facing surfaces of the blocks are bonded together and the retaining wall structure has increased lateral strength.

12. The method of constructing a retaining wall structure of claim 11, wherein the embedding step further comprises:

positioning the proximal end of the anchor sheet on the first layer of cementitious material; and placing a second layer of the cementitious material on both the first layer of cementitious material and the proximal end of the anchor sheet, thereby fully embedding the proximal end in the cementitious material.

13. The method of constructing a retaining wall structure of claim 11, wherein positioning the backfill step further comprises:

positioning a layer of gravel adjacent the retaining wall structure such that a first portion of the anchor sheet is embedded in the gravel; and positioning a layer of soil adjacent the layer of gravel such that a remainder of the anchor sheet is embedded in the soil.

* * * * *